US007201357B2

(12) United States Patent
Price et al.

(10) Patent No.: US 7,201,357 B2
(45) Date of Patent: Apr. 10, 2007

(54) ADJUSTABLE WALL HANGER FOR PICTURES AND THE LIKE

(76) Inventors: Cory D. Price, 2588 Cimarron La., Rockford, IL (US) 61109; Royletta E. Price, 114 E. Elm St., McConnell, IL (US) 61050

( * ) Notice: Subject to any disclaimer, the term of this patent is extended or adjusted under 35 U.S.C. 154(b) by 0 days.

(21) Appl. No.: 11/124,778

(22) Filed: May 9, 2005

(65) Prior Publication Data

US 2006/0249645 A1 Nov. 9, 2006

(51) Int. Cl.
*A47G 1/24* (2006.01)
*B60R 1/02* (2006.01)

(52) U.S. Cl. ..... 248/477; 248/475.1; 248/476

(58) Field of Classification Search ..... 248/477, 248/466, 475.1, 476, 488, 490, 495, 496
See application file for complete search history.

(56) References Cited

U.S. PATENT DOCUMENTS 2,532,162 A * 11/1950 Goss ..... 248/477
2,696,962 A * 12/1954 Goss ..... 248/477
2,975,994 A 3/1961 Goss
3,360,229 A 12/1967 Beyer
3,900,923 A 8/1975 Thomas
3,945,599 A 3/1976 Spier et al.
4,340,199 A 7/1982 Brock
4,364,537 A * 12/1982 Helzer ..... 248/448
4,557,455 A 12/1985 Benjamin
4,623,177 A 11/1986 McKinney
4,632,438 A * 12/1986 McKinney ..... 292/87
5,040,712 A 8/1991 Pesonen et al.
5,480,120 A 1/1996 Bruner
5,584,462 A * 12/1996 Reese ..... 248/477
6,299,123 B1 10/2001 Hayde
6,666,425 B1 12/2003 Ferguson

* cited by examiner

*Primary Examiner*—Amy J. Sterling
(74) *Attorney, Agent, or Firm*—Meroni & Meroni, P.C.; Charles F. Meroni, Jr.; Christopher J. Scott

(57) ABSTRACT

A vertically adjustable wall hanger device comprising a hanger and a hanger mount. The hanger comprises a main hanger body, a first set of serrations positioned in side-to-side spaced relation to one another on a back side of the main hanger body, and a center slot on the main hanger body and a hanging hook provided on the main hanger body. The hanger mount comprises a main mount body having a second set of serrations on a body face positioned in side-to-side spaced relation and sized and shaped similar and confronting the first set of serrations. The second set of serrations is located on a back side of the main hanger mount body with the hanger mount body having a screw hole confronting the center slot on the main hanger body. A center hanger mount is held in the main mount body positioned in co-axial alignment with the center slot provided in the main hanger body. The hanger and the hanger mount are assembled together by meshing the serrations in the first and second sets of serrations in a pre-selected position to accommodate users' positioning requirements, and a mounting screw extends through the hanger body and the center hanger mount in clamped abutting assembly together to hold the hanger and the hanger mount in superimposed lapped engagement together in the pre-selected position.

9 Claims, 7 Drawing Sheets

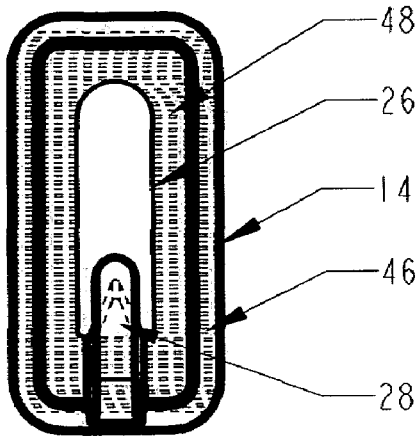
FIG. 12
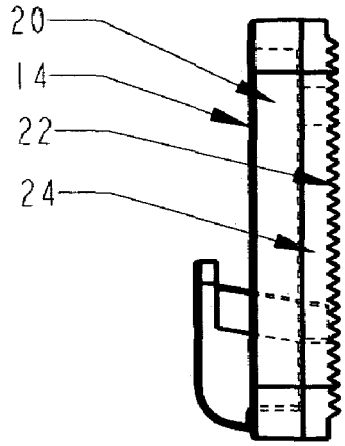
FIG. 13
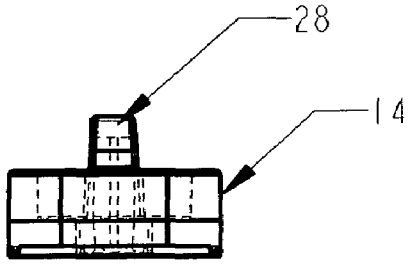
FIG. 14
FIG. 15
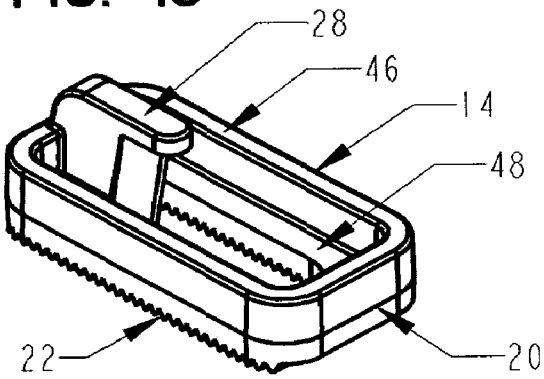
FIG. 16
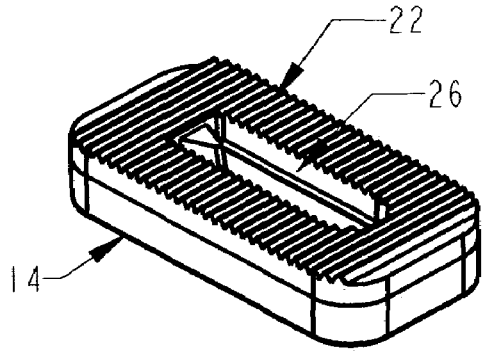

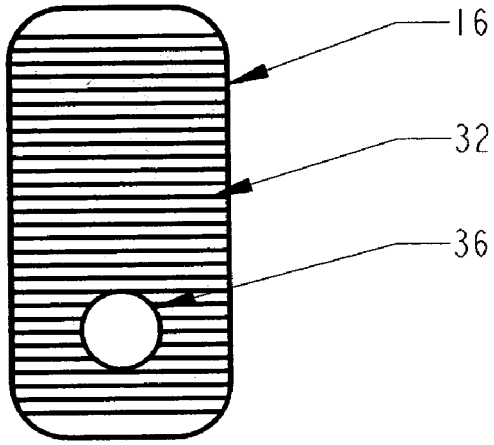
FIG. 17
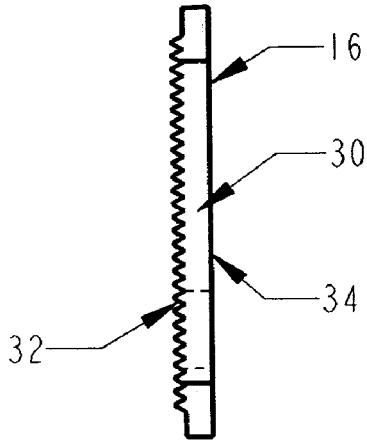
FIG. 18
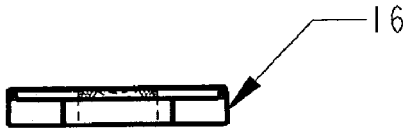
FIG. 19
FIG. 20
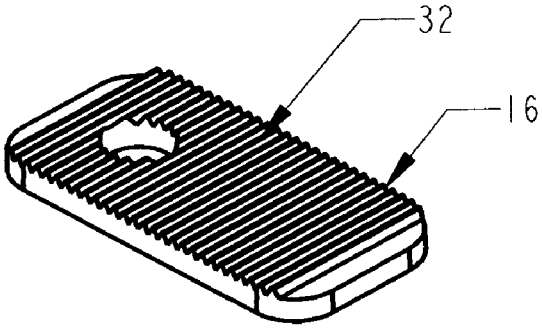
FIG. 21
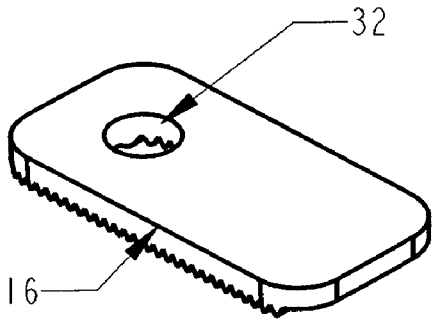

ADJUSTABLE WALL HANGER FOR PICTURES AND THE LIKE

BACKGROUND OF THE INVENTION

1. Field of the Invention

This invention relates to an adjustable wall hanger for adjustably hanging or suspending photographs, mirrors, paintings and the like on an indoor or outdoor building wall surface.

2. Description of the Prior Art

Heretofore various adjustable wall hangers have been proposed in some form or another utilizing the theory of attaching an adjustable hanger to a vertical wall surface for mounting pictures, photographs, mirrors, and the like have been proposed. Examples of such previously proposed types of wall hangers are listed below:

| U.S. Pat. No. | Patentee | Description |
|---|---|---|
| 6,666,425 | Ferguson | Vertically-Adjustable Picture Hangar |

U.S. Pat. No. 6,666,425 discloses a vertically adjustable picture hangar including a main body securable to a vertical surface with mounting screws, nails, or other similar fasteners, and an adjustable bracket. The main body includes a pair of mounting apertures and is generally symmetrical about a plane passing through the axes of the mounting apertures, a vertically-oriented linear ratchet having a plurality of teeth, and a pair of parallel, outwardly-facing spaced apart peripheral tracks or grooves. Each track is open at the top and includes a pair of cylindrical locator pins that enter the tracks at the top of the main body and slide within them. Also included in the adjustable bracket is a pawl that engages the linear ratchet. The locator pins allow the adjustable bracket to be rotated upwardly so the pawl can be disengaged from the linear ratchet, the adjustable bracket moved up or town, and the pawl re-engaged with the ratchet.

The prior art, including the above noted patent, does not disclose the particular unique structural configuration possessed by my vertically adjustable wall hanger device for adjustably suspending a photograph, a painting or similar object to be mounted on an upright wall which may be inexpensively manufactured and easily operated by a person that needs to make a quick and accurate placement of a wall hanger device with a minimum of difficulty.

More specifically, the vertically adjustable wall hanger device has a lower profile which does not protrude as far out from the mount surface as opposed to other known picture hangers. The vertically adjustable wall hanger device also has the following additional features and advantages:

1. The vertically adjustable wall hanger device has a single mounting point, requiring only one hole in the mounting surface as distinguished from other wall hangers which require multiple mounting points.
2. The vertically adjustable wall hanger device permits a much finer adjustment down to 1/32 of an inch as distinguished from other designs requiring large adjustments.
3. The vertically adjustable wall hanger device has a mounting screw that goes through both pieces making it more secure as distinguished from other designs where the screw passes through only one of two pieces.
4. The vertically adjustable wall hanger device has sets of serrations on two pieces which are shaped and configured so as to enable the pieces to be vertically moved relative to each other so that the serrations on the pieces can be engaged at different locations to permit much finer adjustment down to 1/32 of an inch without the use of dual opposing cams or dowels as set forth in U.S. Pat. No. 6,666,425.

SUMMARY OF THE INVENTION

According to the present invention, there is provided a vertically adjustable wall hanger device comprising a hanger and a hanger mount. The hanger comprises a main hanger body, a first set of serrations positioned in side-to-side spaced relation to one another on a back side of the main hanger body, and a center slot on the main hanger body and a hanging hook provided on the main hanger body. The hanger mount comprises a main mount body having a second set of serrations on a body face positioned in side-to-side spaced relation and sized and shaped similar and confronting the first set of serrations. The second set of serrations is located on a back side of the main hanger mount body with the hanger mount body having a screw hole confronting the center slot on the main hanger body. A center hanger mount is held in the main mount body positioned in co-axial alignment with the center slot provided in the main hanger body. The hanger and the hanger mount are assembled together by meshing the serrations in the first and second sets of serrations in a pre-selected position to accommodate users' positioning requirements, and a mounting screw extends through the hanger body and the center hanger mount in clamped abutting assembly together to hold the hanger and the hanger mount in superimposed lapped engagement together in the pre-selected position.

BRIEF DESCRIPTION OF THE DRAWINGS

FIG. 12 shows a front view of my hanger.

FIG. 13 shows a side view of the hanger shown in FIG. 12.

FIG. 14 shows a top view of the hanger shown in FIG. 13.

FIG. 15 shows a perspective view of the hanger shown in FIG. 12.

FIG. 16 shows a bottom perspective view of the hanger shown in FIG. 12.

FIG. 17 shows a front view of my hanger mount.

FIG. 18 shows an edge view of the hanger mount shown in FIG. 17.

FIG. 19 shows a top plan view of the hanger mount shown in FIG. 18.

FIG. 20 shows a top perspective view of the hanger mount shown in FIG. 17.

FIG. 21 shows a bottom perspective view of the hanger mount shown in FIG. 20.

BRIEF DESCRIPTION OF THE PREFERRED EMBODIMENT(S)

Figures 1, 2:
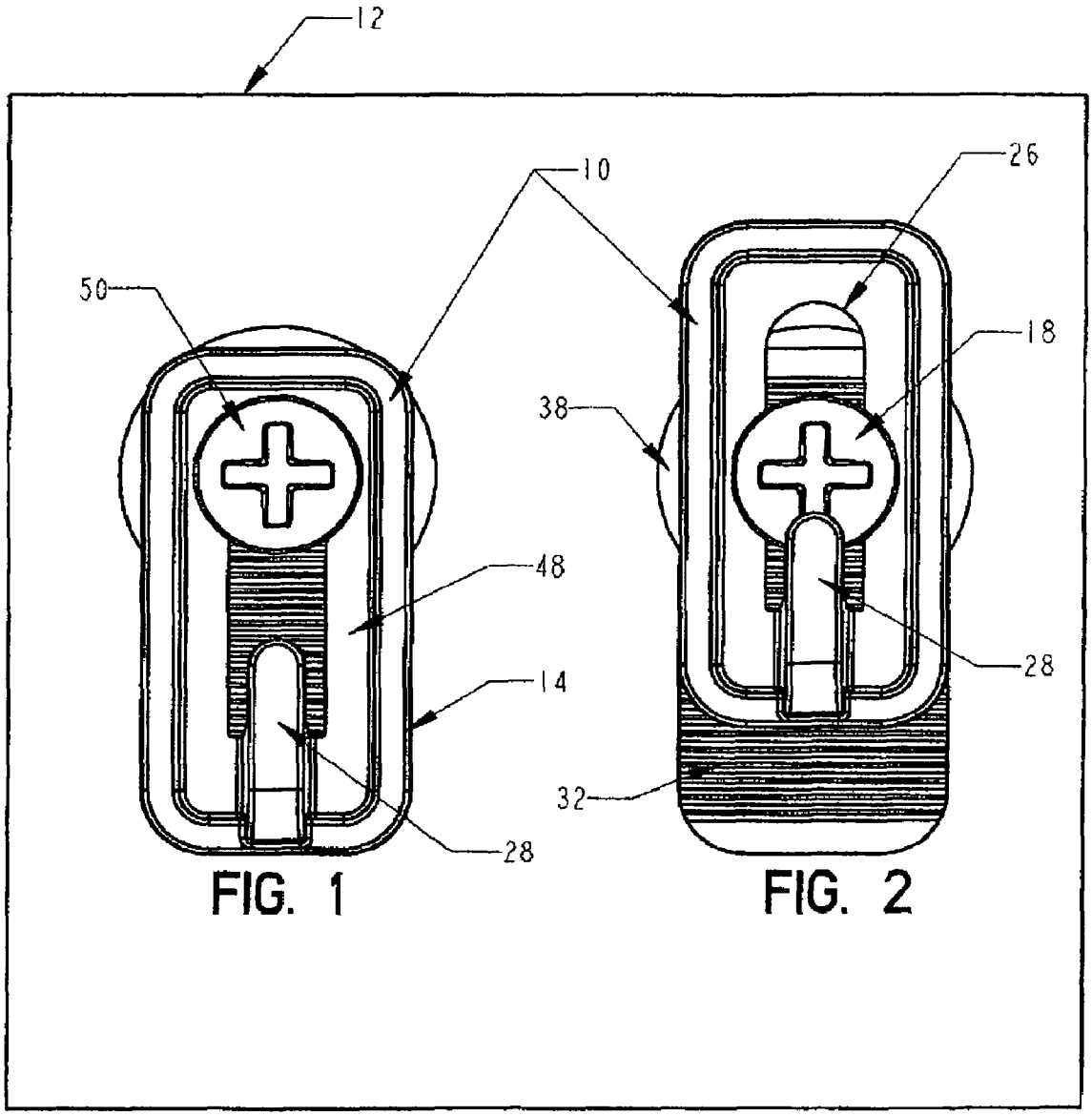
FIG. 1 is a front view of my adjustable wall hanger.
FIG. 2 is a front view of the adjustable wall hanger shown in FIG. 1 only with a hanger shown in an adjusted elevated position relative to a hanger mount.
Figures 3, 4:
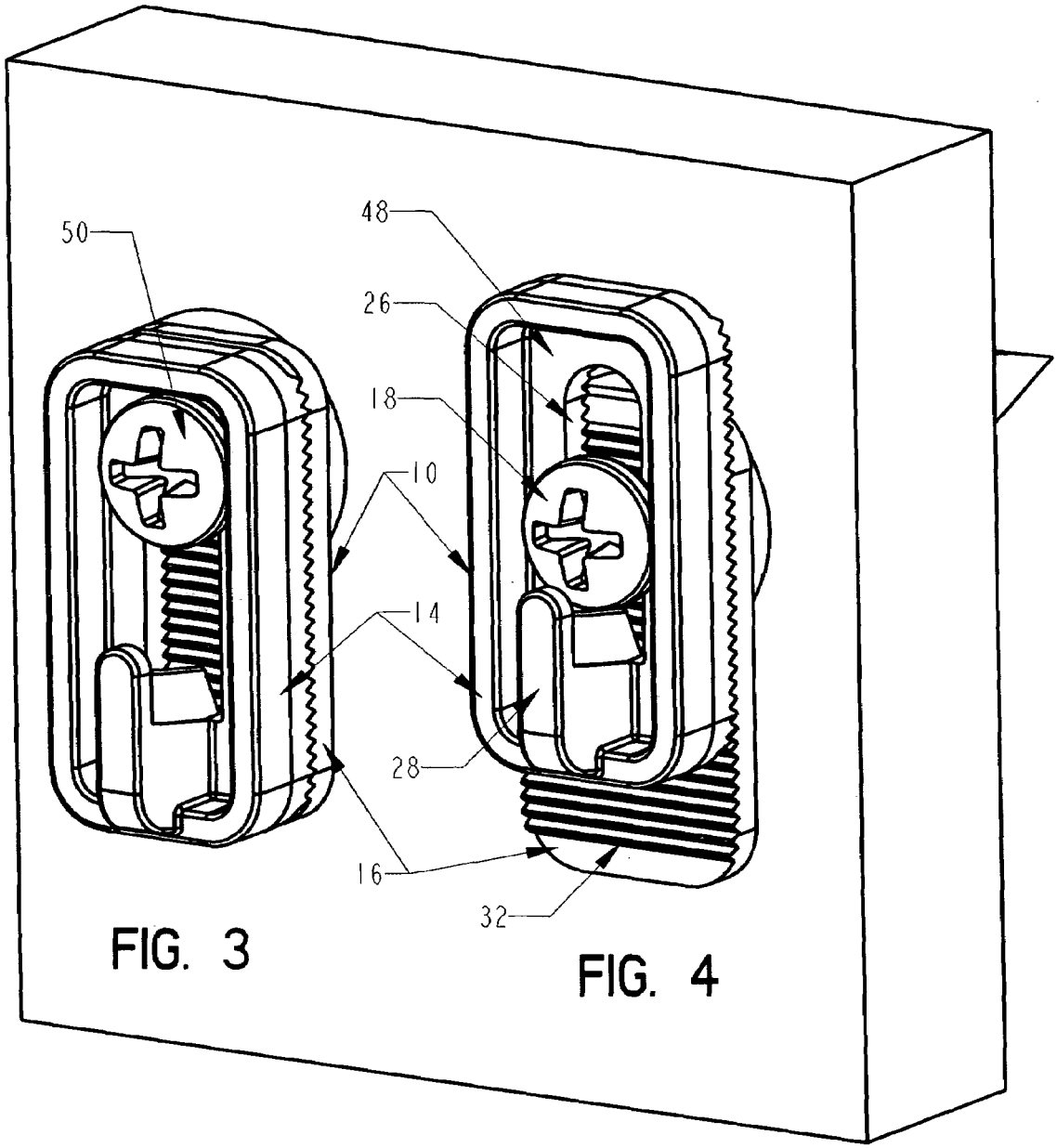
FIG. 3 is a perspective view of the wall hanger shown in FIG. 1.
FIG. 4 is a perspective view of the wall hanger shown in FIG. 2.

A new and improved vertically adjustable hanger device identified at 10 in the attached drawings. This hanger device 10 is adapted for hanging pictures, photographs, mirrors and paintings and other assorted articles where it is desired to mount the same on a wall 12 (diagrammatically illustrated in drawings), such as a vertical surface herein disclosed and illustrated in FIGS. 1–21, inclusive. These drawings show a single embodiment and further illustrate in FIGS. 8–11 how the adjustable hanger device 10 can be adjusted. Our adjustable hanger consists of three parts, namely, a dish-shaped hanger 14, a center hanger mount 16 and a mounting screw 18 which can be used with or without a threaded screw receiving member 38. (FIGS. 8–11) The mounting screw 18 can be used for where the hanger device 18 is to be mounted on a hard board wall member or with the threaded screw receiving member 38 when the hanger device 10 is to be mounted on a so-called drywall which is of a softer construction and which can require a modified fastener to hold the hanger device 10 securely thereto. The hanger 14 is preferably dish-shaped in accordance with features of this invention. The parts 14 and 16 are comprised of a suitable synthetic plastic such as can be manufactured by using known types of injection molding equipment. The dish-shaped hanger 14 comprises a main body or a first main body 20, a first set of serrations 22 on a back or back side 24 of the hanger 14, a center slot 26 and a hanging or hanger hook 28 positioned for supporting an object hung on the hanger hook 28, the hanger hook 28 being fixedly connected to said first main mount body 20 underlying said center slot 26 with a free end of said hanger hook 28 extending upwardly and overlying said center slot 26 on said first main hanger body 20, the banger hook 28 being fixedly connected to said first main mount body 20 and movable with said first main hanger body 20 in upward and downward directions relative to said second main mount body 30 to assist in adjusting the first and second sets of serrations 22,32 when being disengaged and re-engaged in different positions with relation to one another. The hanger 14 and the center hanger mount 16 are assembled together by meshing said first and second sets of serrations 22,32 in a pre-selected position to accommodate users' positioning requirements while maintaining the center slot 26 and the center mount hole 36 in co-axial alignment. A mounting screw 18 extends through said center slot 26 and said screw hole 13 retaining the hanger 14 and the hanger mount 16 to together in superimposed lapped retained assembly in the pre-selected position, the mounting screw 18 overlying the hanger hook 28 for easy access when being extended through said center slot 26 and said center mount hole 36. The hanger mount 16 comprises a main body or a second main body 30, a second set of serrations 32 on a front side of the hanger mount 16 and a flat back 34 for wall engagement, and a center mount hole 36 for receiving an attachment screw. The two parts 14 and 16 are assembled together by meshing or nesting the sets of serrations 22 and 32 and these two parts are held in place by the mounting screw 18 having internal threads 42 coacting with the mounting screw 18. In the illustrated preferred embodiment, the serrations in both sets 22 and 32 are of identical size and shape with unobstructed free and open ends so that the sets can be easily adjusted relative to one another for ease of assembly in an optimum adjusted position.

An important object of our invention is to provide a wall hanger device 10 which has only a single mounting point, requiring only one hole 13 in the mounting wall or surface 12 so as to minimize the number of wall holes that must be provided in a vertical wall surface or wall 12.

According to another important feature of my invention, my new adjustable hanger 10 enables a much smaller adjustment as down to 1/32" as compared to prior known hangers.

Yet another important feature of our invention relates to the adjustable hanger 10 where the mounting screw 18 extends through both pieces or parts of the adjustable hanger 10 making it a more secure construction. To this end, the screw 18 extends through the center slot 26 and into a center mount hole 36 (FIG. 17) and finally into a threaded screw receiving member 38.

According to still another important feature of our invention, we have provided an adjustable hanger device 10 comprised of two (2) parts 14 and 16 having confronting first and second sets of serrations 22 and 32 for nested engagement together in one of a series of selectable positions to obtain a most precise positioning of the first and second sets of serrations 22 and 32 for optimum positioning of the hanger 14 and the hanger mount 16 relative to one another to obtain a finer and an improved adjustment capability.

When it is desired to use the improved adjustable hanger device 10, the user should determine where the article to be hung is to be located on a wall surface 12. There are many writings about how the wall hangers are to be made, and there are situations where it is desired to only hang a single article or wall hanging and other situations where multiple wall hangings are to be made in some sort of a pre-designed arrangement on a wall surface. For the purpose of this discussion, we are here only referring to how the improved adjustable hanger device 10 can be used to mount a single wall hanger or mount on a wall surface.

Figure 9:
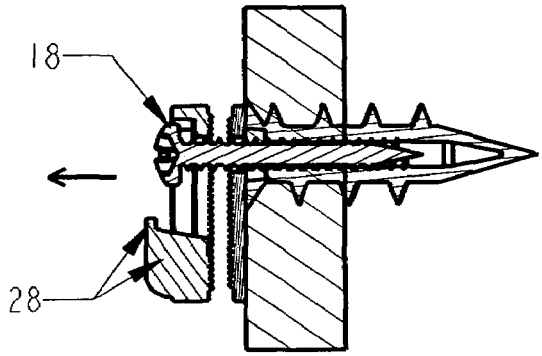
Figure 10:
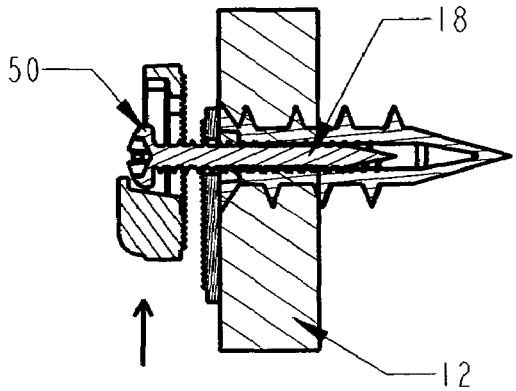
Figure 11:
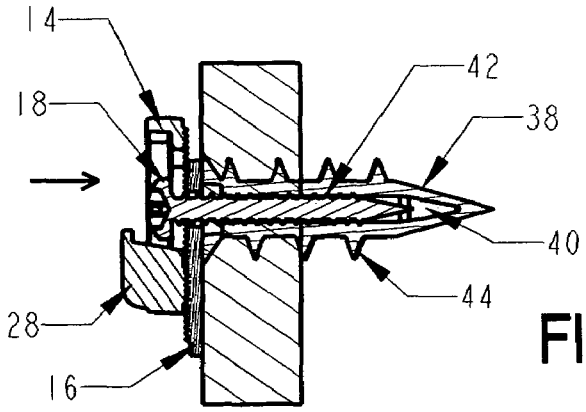

To this end, a location on a wall surface must be first chosen. If desired, a threaded screw receiving member 38 such as shown in FIGS. 9–11, can be used to provide a screw receiving threaded mounting socket 40 having internal screw threads 42 and external screw threads 44 for wall engagement for receipt of a mounting screw 18. After the socket 40 has been provided, if used, then the screw 18 can be threaded through the center slot 26 on the mount body 20 of the hanger 14 and then through a center mount hole 36 on the hanger mount 16 in such a way that the hanger 14 and the hanger mount 16 are loosely positioned on the mounting screw 18 in spaced apart relation, as shown in FIGS. 9 and 10. At this point in time, the installer can make a judgment about where hanger hook 28 on the hanger 14 is to be located, whereafter the first and second sets of serrations 22 and 32 are engaged and then the mounting screw 18 is turned so as to cause the hanger 14 and the mount hanger 16 to be clamped with the serrations 22 and 32 in the respective sets then being secured in a pre-selected position as shown in FIG. 11.

In FIG. 11, the arrow shows the direction of movement of the mount hanger 16 as the components are being assembled and clamped in adjusted relation.

FIG. 9 shows the components in relative position prior to being adjusted and the arrow in FIG. 9 shows how hanger 14 carrying the hanging hook 28 can be moved away from the mount hanger 16 during the time when adjustment is being made between the two sets of serrations 22 and 32.

In FIG. 10, the arrow there shows how the hanger 14 can be vertically moved to an adjusted position relative to the mount hanger 16. Then the sets of serrations 22 and 32 are engaged and clamped together as shown in FIG. 11. If the adjustment is unsatisfactory to the installer, then the screw 18 can be turned and released to enable the hanger 14 and the mount hanger 16 to be separated so that the serrations 22 and 32 can be disengaged preparatory to set the sets of serrations 22 and 32 in a new position of adjustment.

The dish-shaped hanger 14 has a unique construction. To this end, the dish-shaped hanger 14 has an annular rim hanger section 46 surrounding the center slot 26. The center slot 26 is located in a bottom hanger section 48 surrounded by the annular rim hanger section 46. The mounting screw 18 preferably has a rounded screw head 50 so a picture hanger wire is less likely to become snagged on the screw head 50 when it is slipped over the hanger hook 28 when hanging a painting from a hanger wire. The dish-shaped hanger 14 defines a dished area 52 bounded by the annular rim hanger section 46 with the center slot 26 being located at the bottom of the dished area 52 a sufficient depth to allow the screw head 50 to be lodged in the dished area 52 so that the head 50 does not protrude above or outside of the annular rim hanger section 46.

When the screw 18 is set into the wall 12 to hold the mount hanger 16 and the dish-shaped hanger 14 to the wall 12, and after the sets of serrations 22 and 32 have been adjusted, it will be seen that the rounded screw head 50 is in flush engagement against the bottom of the bottom hanger section 48 and surrounded by the annular rim hanger section 46 beneath the hanging hook 28 so that profile of the adjustable wall hanger device 10 can be minimized all according to the features of this invention.

Figure 5:
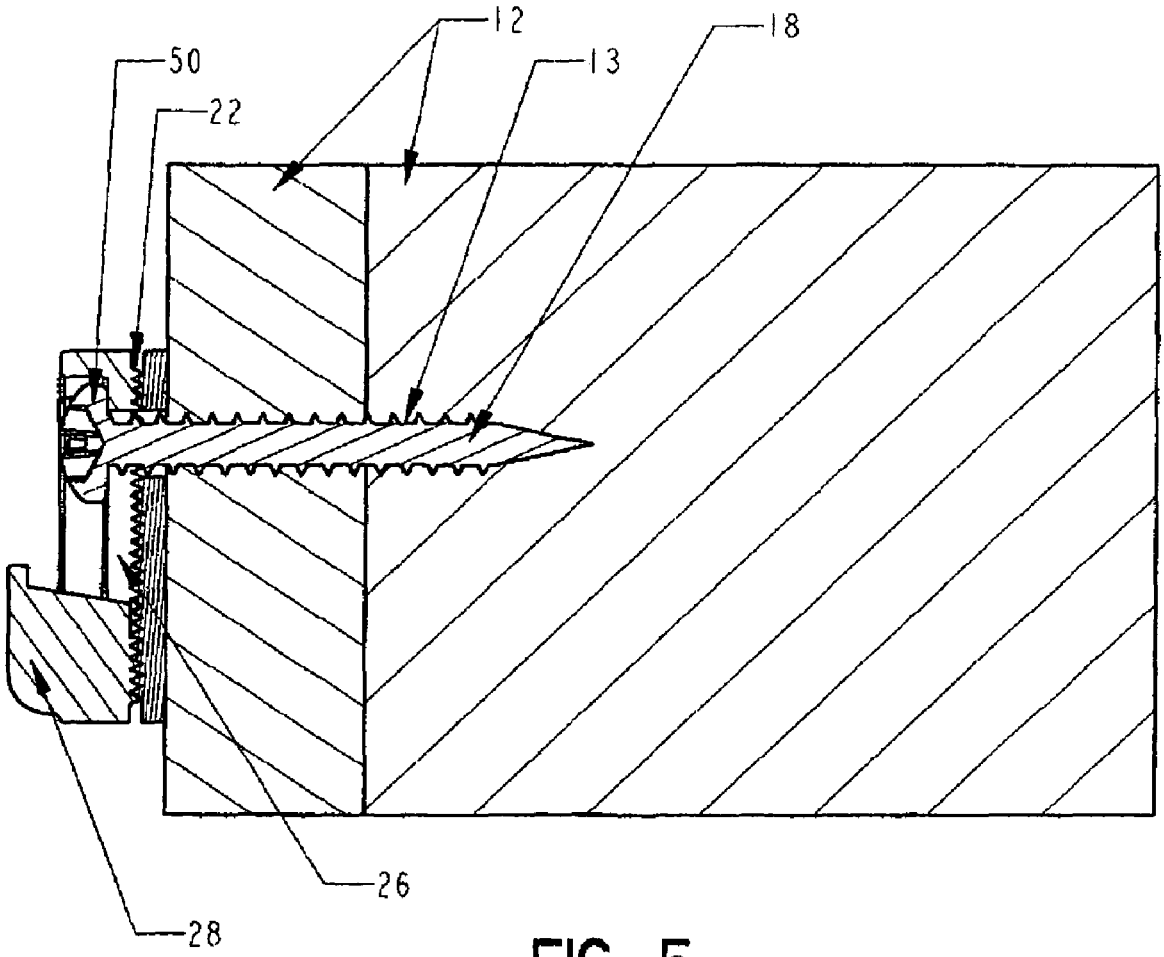
FIG. 5 is an enlarged vertical cross-section of my adjustable wall hanger shown in FIG. 1 mounted on a wall surface.
Figure 6:
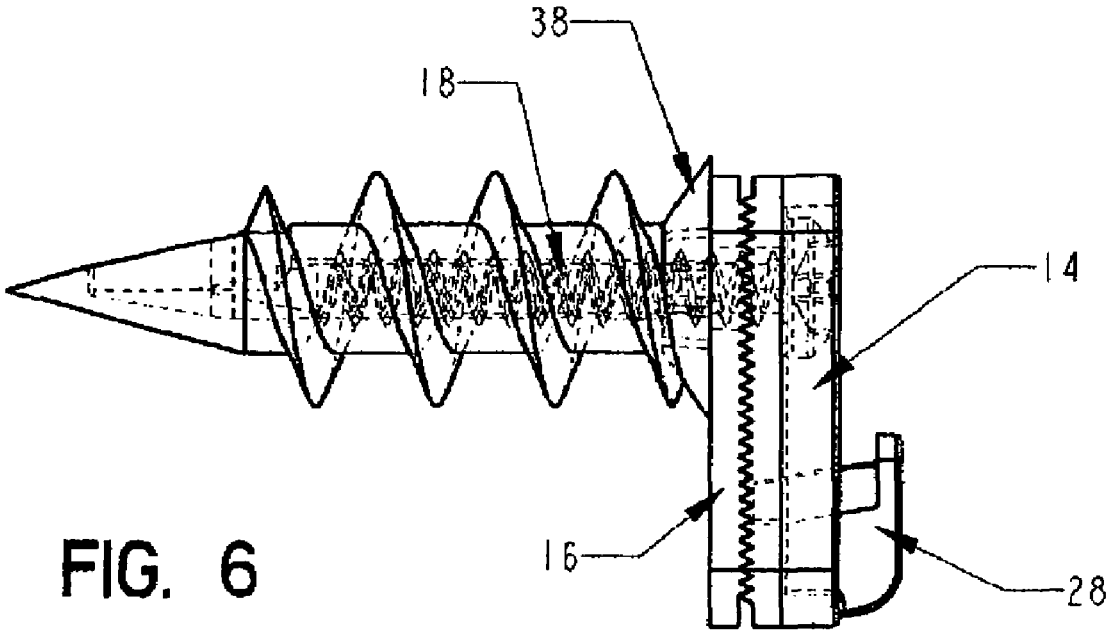
FIG. 6 is a side view of the adjustable wall hanger shown in FIG. 1.
Figure 7:
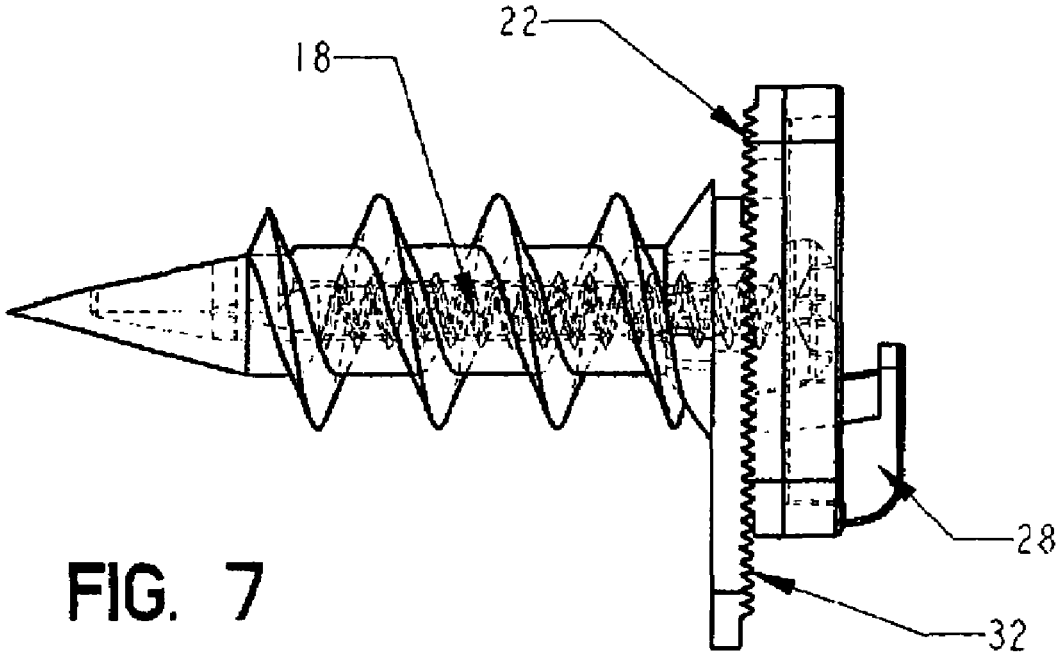
FIG. 7 is a side view of the adjustable wall hanger shown in FIG. 2.
Figure 8:
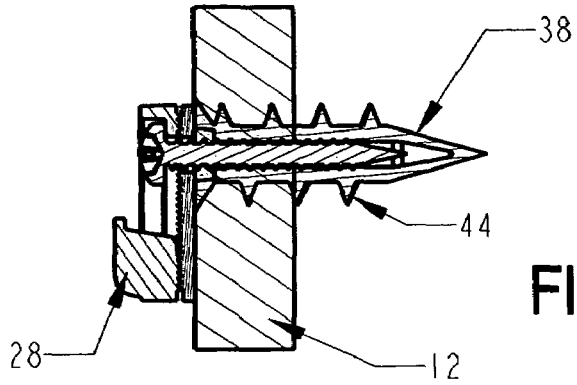
FIGS. 8, 9, 10 and 11 are all vertical sections similar to FIG. 5 only shown with a hanger which can be manipulated by adjustment of a mounting screw and movement of the hanger mount to variable adjusted positions and then resecured in place on a wall with the adjustment screw screwed into a threaded screw receiving member and the arrows showing directions of movement for adjustment of the hanger mount, as seen in FIGS. 9, 10 and 11.

The screw 18 can be used as shown in FIG. 5 where it is screwed into a wall. As an example, if the wall 12 has wood paneling, it may not be necessary to use a threaded screw receiving member 38, as shown in FIGS. 8–11, inclusive. Threaded screw receiving members 38 are generally known in this art and are used when the wall 12 is comprised of a softer material where the load of the wall hanging might cause the screw to pull away from the wall 12.

The dish-shaped hanger 14 defines a dished area 52 with the elongated center slot 26 and a screw head 50 provided on the screw 18 lodged and partially concealed by the hanger hook 28 which at least partially overlies the elongated center slot 26.

Accordingly, although the invention has been described by reference to a preferred single embodiment, it is not intended that the novel assembly be limited thereby, but that modifications thereof are intended to be included as falling within the broad scope and spirit of the foregoing disclosure, the following claims and the appended drawings.

We claim:

1. A vertically adjustable wall hanger device comprising:

a hanger and a hanger mount, the hanger comprising a first main hanger body, a first set of serrations positioned in side-to-side spaced relation to one another on a back side of said first main hanger body, a center slot on said first main hanger body, the hanger mount comprising a second main mount body, the second main mount body having a second set of serrations on a body face positioned in side-to-side space relation to one another and being sized and shaped and positioned in confronting relation to said first set of serrations, the second set of serrations being located on a front side of said second main mount body and with the second main mount body having a center mount hole confronting the center slot on the first main hanger body, a hanger hook positioned for supporting an object hung on the hanger hook, the hanger hook being fixedly connected to said first main hanger body underlying said center slot with a free end of said hook extending upwardly and overlying said center slot on said first main hanger body, the hanger hook being fixedly connected to said first main hanger body and movable with said first main hanger body in upward and downward directions relative to said second main mount body to assist in adjusting the first and second sets of serrations when being disengaged and re-engaged in different positions with relation to one another, said hanger and said hanger mount being assembled together by meshing said first and second sets of serrations in a pre-selected position to accommodate users' positioning requirements while maintaining the center slot and the center mount hole in co-axial alignment, and a mounting screw extending through said center slot and said screw hole retaining the hanger and the hanger mount together in superimposed lapped retained assembly in the pre-selected position, the mounting screw overlying the hanger hook for easy access when being extended through said center slot and said center mount hole.

2. The vertically adjustable wall hanger device of claim 1, wherein the first and second set of serrations are finely adjustable down to 1/32 of an inch.

3. The vertically adjustable wall hanger device of claim 1, the first main hanger body being dish-shaped and having an annular rim hanger section surrounding said center slot in a bottom section of the first main hanger body, the mounting screw having a screw head housed inside said annular rim hanger section when the mounting screw head rests on a bottom hanger section with the screw then being extended through center slot and said screw hole.

4. The vertically adjustable wall hanger device of claim 3 wherein each serration in both sets are of identical size and shape and are arranged in rows leaving channels between the serrations which are open at opposite ends and with the channels being of similar shape to said serrations for receipt of a serration in an opposing set of serrations in nested engagement therewith, certain of the second set of serrations being visible from a front side of the vertically adjustable wall hanger device when viewed through said center slot.

5. A vertically adjustable wall banger device comprising:

a hanger and a hanger mount, the hanger comprising a first main hanger body, a first set of serrations positioned in side-to-side spaced relation one another on a back side of said first main hanger body, a center slot on said first main hanger body and a hanging hook provided on said first main hanger body, the hanger mount comprising a second main mount body, the second main mount body having a second set of serrations on a body face positioned in side-to-side spaced relation and being sized and shaped the same as said first set of serrations and with the first and second sets of serrations disposed in confronting nested relation, the second set of serrations being located on a front side of said second main mount body and with the second main mount body having a screw hole so positioned on the second main mount body to confront and be in alignment with the center slot on the first main hanger body when in assembled relation, said hanger and said hanger mount being assembled together by meshing said serrations in said first and second sets of serrations in a pre-selected position to accommodate users' positioning requirements, a mounting screw extending through said center slot and into said screw hole holding the hanger and the mount in superimposed lapped retained assembly in the pre-selected position on a walls, and wherein the hanger and the hanger mount have the same vertical and width dimensions.

6. The vertically adjustable wall hanger device of claim 5 wherein the first and second set of serrations are finely adjustable down to 1/32 of an inch.

7. A vertically adjustable wall hanger device comprising:

a hanger and a hanger mount, the hanger comprising a first main hanger body, a first set of serrations positioned in side-to-side spaced relation to one another on a back side of said first main hanger body, a center slot on said first main hanger body and a hanger hook provided on said first main hanger body, the hanger mount comprising a second main mount body, the second main mount body having a second Set of serrations on a body face positioned in side-to-side spaced relation and being sized and shaped the same as said first set of serrations and with the first and second sets of serrations being disposed in confronting nested relation, the second set of serrations being located on a front side of said second main mount body and with the second main mount body having a screw hole so positioned on the second main mount body to confront and be in alignment with the center slot on the first main hanger body when in assembled relation, said hanger and said hanger mount being assembled together by meshing said serrations in said first and second sets of serrations in a pre-selected position to accommodate users' positioning requirements, a mounting screw extending through said center slot and into said screw hole holding the hanger and the hanger mount in superimposed lapped retained assembly in the pre-selected position on a wall, the hanger hook being joined to said hanger at a location immediately below the center slot and with the hanger hook being centered on the hanger and joined to the hanger beneath the slot of the hanger hook extending upwardly in proximity to the center slot at a lower end of the center slot.

8. The vertically adjustable wall hanger device of claim 7 wherein the hanger and the hanger mount have the same vertical and width dimensions.

9. A vertically adjustable wall hanger device comprised of a dish-shaped hanger, a hanger mount, and a screw, the dish-shaped hanger and the hanger mount having confronting sets of serrations sized and shaped for locking engagement together in variable adjustable positions so that the dish-shaped hanger and the hanger mount can be moved longitudinally relative to one another for fine adjustment of the dish-shaped hanger and the hanger mount relative to one another, the dish-shaped hanger having an elongated center slot therein and with the screw being engageable through the slot and through a Center mount hole provided in said hanger mount for receiving the mounting screw, the dish-shaped hanger having a hanger hook integral with a front side of said dish-shaped hanger, wherein the dish-shaped hanger defines a dished area encompassing the elongated center slot and a screw head provided on the screw, the screw head being lodged in the dished area and partially concealed by the hanger hook which at least partially overlies the elongated center slot.

* * * * *